United States Patent [19]

Bowerman

[11] 4,294,595

[45] Oct. 13, 1981

[54] VACUUM CLEANER INCLUDING AUTOMATIC SHUTOFF DEVICE

[75] Inventor: Leonard E. Bowerman, Fairfield, Conn.

[73] Assignee: Electrolux Corporation, Old Greenwich, Conn.

[21] Appl. No.: 170,244

[22] Filed: Jul. 18, 1980

[51] Int. Cl.[3] ..... B01D 46/46; A47L 9/12

[52] U.S. Cl. ..... 55/213; 55/214; 55/274; 55/DIG. 3; 15/339; 15/DIG. 11

[58] Field of Search ..... 55/213, 214, 274, DIG. 3, 55/DIG. 34, 212, 215, 283; 15/339, DIG. 11; 340/568, 607, 614; 200/83 A; 116/70, DIG. 25

[56] References Cited

U.S. PATENT DOCUMENTS

| | | | |
|---|---|---|---|
| 2,737,262 | 3/1956 | Ferraris | 55/213 |
| 2,954,751 | 10/1960 | Barnes, Jr. | 55/DIG. 34 |
| 3,073,097 | 1/1963 | Hallett et al. | 55/283 |
| 3,172,743 | 3/1965 | Kowalewski | 55/214 |
| 3,587,514 | 6/1971 | Autrand | 15/339 |
| 4,020,525 | 5/1977 | Fromknecht et al. | 55/DIG. 34 |
| 4,040,042 | 8/1977 | Mayer | 55/274 |
| 4,184,225 | 1/1980 | Leinfelt | 15/339 |

FOREIGN PATENT DOCUMENTS

| | | | |
|---|---|---|---|
| 2439710 | 3/1976 | Fed. Rep. of Germany | 15/339 |
| 2252076 | 6/1975 | France | 55/274 |

*Primary Examiner*—David L. Lacey
*Attorney, Agent, or Firm*—William S. Henry

[57] ABSTRACT

An automatic shutoff arrangement for a vacuum cleaner of the "clean air" type in which the vacuum fan is downstream of the dirty air passageway and vacuum filter. The automatic shutoff arrangement includes an apparatus for sensing a selected characteristic of the air flow at a first point adjacent the entrance to the dirty air passageway and at a second point along the clean air passageway between the vacuum filter and fan and operates in response to a relative change in the selected characteristic between such points to interrupt power to the vacuum motor and/or indicate to the operator that the dirty air passageway is obstructed or vacuum filter is full.

7 Claims, 7 Drawing Figures

VACUUM CLEANER INCLUDING AUTOMATIC SHUTOFF DEVICE

BACKGROUND OF THE INVENTION

1. Field of the Invention

The present invention relates generally to automatic controls for vacuum cleaners and more specifically to automatic motor control shutoff systems designed to respond to clogged conditions present anywhere in the dirty air passageway or filter of a vacuum cleaner of the clean air variety and further responsive to the presence and proper placement of the filter as a prerequisite to motor operation.

2. History of the Invention

Automatic arrangements for signaling the operator when the dust bag or filter of a vacuum cleaner has become clogged are well known in the art and reference to U.S. Pat. No. 2,230,113 will enable an appreciation of a typical arrangement utilized in conventional upright vacuum cleaners of several decades ago. Such an automatic arrangement is found in the context of an upright cleaner which operates on "dirty air" principles; that is a system wherein a nozzle inlet is provided in a base or lower housing of the cleaner and the fan for providing suitable suction is likewise contained in such housing and the outlet of the fan forces the air into a filter bag or receptacle. In such a system, the variation in the back pressure of air due to the increased obstruction when the bag becomes full results in actuation of a diaphragm which is arranged to signal the operator or user that a clogged condition exists in the filter bag.

More pertinent to a consideration of the present invention is the automatic shutoff arrangement disclosed in U.S. Pat. No. 3,172,743. Although the vacuum cleaner disclosed therein is not an "upright" in the classic sense, it does embody the well known "clean air" principle by which is meant that the fan in the system does not have to process dirty air but instead is so located that dirt is removed upstream of the fan location by reason of having the filter appropriately located upstream of the fan unit. Moreover, the bag lock-out scheme disclosed in U.S. Pat. No. 3,172,743 does provide both an indication that there is no bag effectively present in the cleaner, and, at the same time, prevents the operation of the fan motor when such a condition exists. Additionally, a pressure differential actuated switch is arranged so as to give a signal to the operator when a "full bag" or clogged filter condition exists within the bag. However, in the vacuum cleaner disclosed in U.S. Pat. No. 3,172,743, such pressure differential switch does not function to interrupt power to the fan motor and thereby prevent the possible damage to the motor assembly caused by the increased thermal load. Further, the pressure differential is sensed between the inlet of the dust bag or filter and the fan and therefore no indication or warning is given should a blockage occur elsewhere in the dirty air passageway of the vacuum system.

Another problem that occurs in the operation of the aforementioned switch which is actuated in response to a predetermined pressure differential is that this differential tends to vary considerably, and in those instances where the switch is designed to shut off the motor, that very action causes reversion of the pressure differential to its original state, thereby allowing the motor to be re-energized.

SUMMARY OF THE INVENTION

The present invention resides in the provision of an automatic motor control shutoff system in a vacuum cleaner of the clean air type. The vacuum cleaner includes a filter, a housing for the filter having a panel or door which is movable to gain access to the filter and a fan assembly downstream of the filter. A pressure differential or air flow responsive switch is connected between the nozzle inlet to the dirty air passageway of the vacuum and the clean air passageway after such air flow has passed through the filter bag. The pressure differential switch is operable in response to a change in the flow of air through the system and causes power to the vacuum motor to be interrupted and simultaneously gives a warning to the operator that the filter is full or that a blockage exists somewhere along substantially the entire length of the dirty air passageway. Another switch automatically prevents motor operation in the event a filter is not present in the filter housing. A relay is provided which interrupts power to the motor and prevents motor operation until such relay is reset. Additionally, valve means are provided for overriding the pressure differential or air flow responsive switch in the event supplemental vacuum tools are utilized with the vacuum cleaner.

It is the primary object of this invention to provide an automatic motor control system for vacuum cleaners of the clean air type which operates to reduce the potential for motor or fan damage which may result if the operation of the motor is continued under decreased air flow due to a blockage in the filter or dirty air passageways of the vacuum cleaner or if motor is permitted to operate and draw dirty air into the fan assembly in instances wherein the filter is not properly installed within its housing.

It is another object of the present invention to provide an automatic motor control system which insures that the vacuum cleaner motor will remain inoperative after such system has sensed a blockage in the dirty air passageways or filter or improper positioning or absence of the filter within the vacuum housing until appropriate correction is made to replace or remove the sensed condition.

A further object of this invention is to provide an automatic control system for a vacuum cleaner of the clean air type wherein a signal is given to the operator warning of a blockage anywhere along the dirty air passageways or if the vacuum filter is not properly positioned with the vacuum cleaner housing.

Yet another object of the invention is to provide a valve assembly for disabling, or bypassing the effects of, the differential pressure or air flow sensing means when a hose adapter is attached to the cleaner at a location along the dirty air passageway.

Another object of the present invention is to measure the differential pressure or other selected characteristic of the air flow in a vacuum cleaner incorporating a clean air system between a point adjacent the inlet of the fan or other point along the clean air passageway and a point adjacent the inlet nozzle in the dirty air passageway of the vacuum so that any and all clogging therebetween can be detected as any such blockage can cause serious maintenance problems if allowed to go undetected.

Further objects, features and advantages of the invention will be apparent from the following description considered in connection with the accompanying drawings which form part of the specification.

DESCRIPTION OF THE PREFERRED EMBODIMENTS

Figure 1:
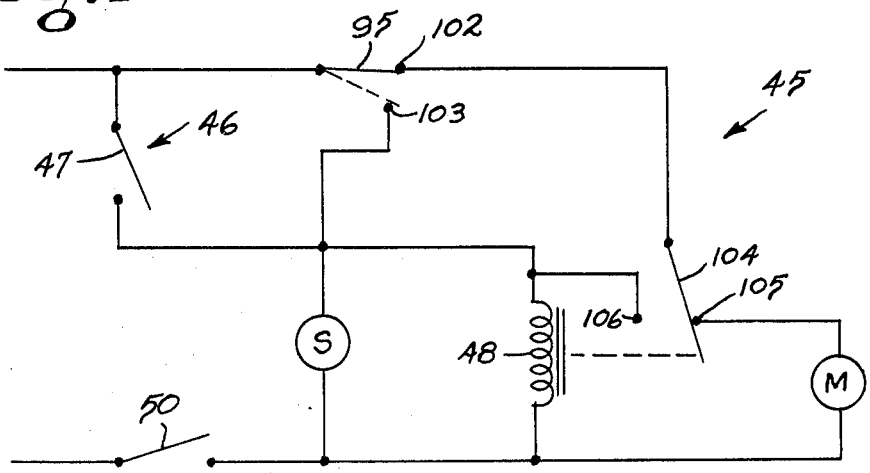
FIG. 1 is a schematic wiring diagram of the present invention.

With continued reference to the drawings, there is shown an upright vacuum cleaner 10 having a power head or base assembly 11 and a body or tank assembly 12. Included in the power head assembly is a motor M which drives a fan and agitator brush assembly (not shown) of conventional design. During operation of the vacuum cleaner, the motor M drives the fan so that a suction is created to draw air into the area adjacent to portion 13 of the head assembly 11 and around the agitator brush assembly. The motor is further operatively connected through a conventional clutch and drive arrangement (not shown) to rotationally drive the agitator brush.

Air drawn into the head assembly 11 as the vacuum fan is operating passes through a first dirty air passageway 15 which extends from the vacuum nozzle intake opening (not shown) adjacent the forward portion 13 of the head assembly to a point adjacent the rear 16 of the head assembly. At the rear of the head assembly, the passageway 15 communicates by way of a flexible hose (not shown) with the inlet 17 of a second dirty air passageway or dirty air channel 18 which extends upwardly within the body assembly 12. As previously discussed, this invention is directed to a vacuum cleaner having a clean air fan system and thus the fan is disposed so as to be downstream of the filter so that the dirt entrained in the air drawn into the vacuum cleaner is removed prior to the point at which such air passes through the fan. Therefore, as the motor and fan assemblies are housed within the base or power head of the vacuum, the flow of air through the dirty air channel 18 must be directed back into the head assembly and to the fan unit.

Figure 7:
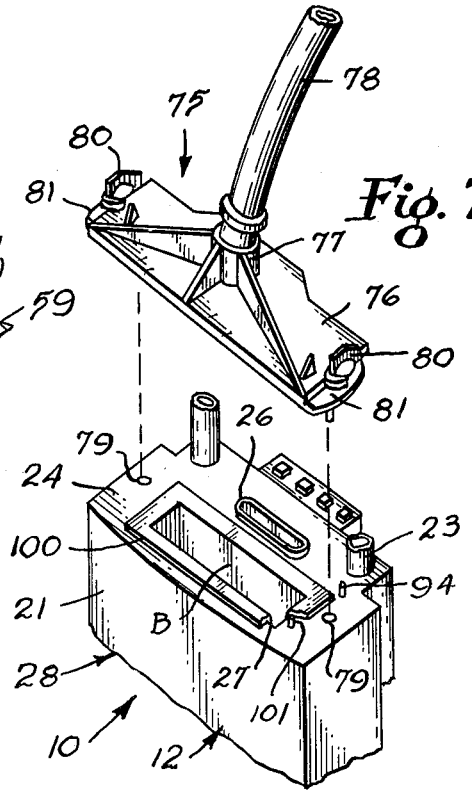
FIG. 7 is an exploded fragmentary perspective view of another embodiment showing a hose adapter.
Figure 2:
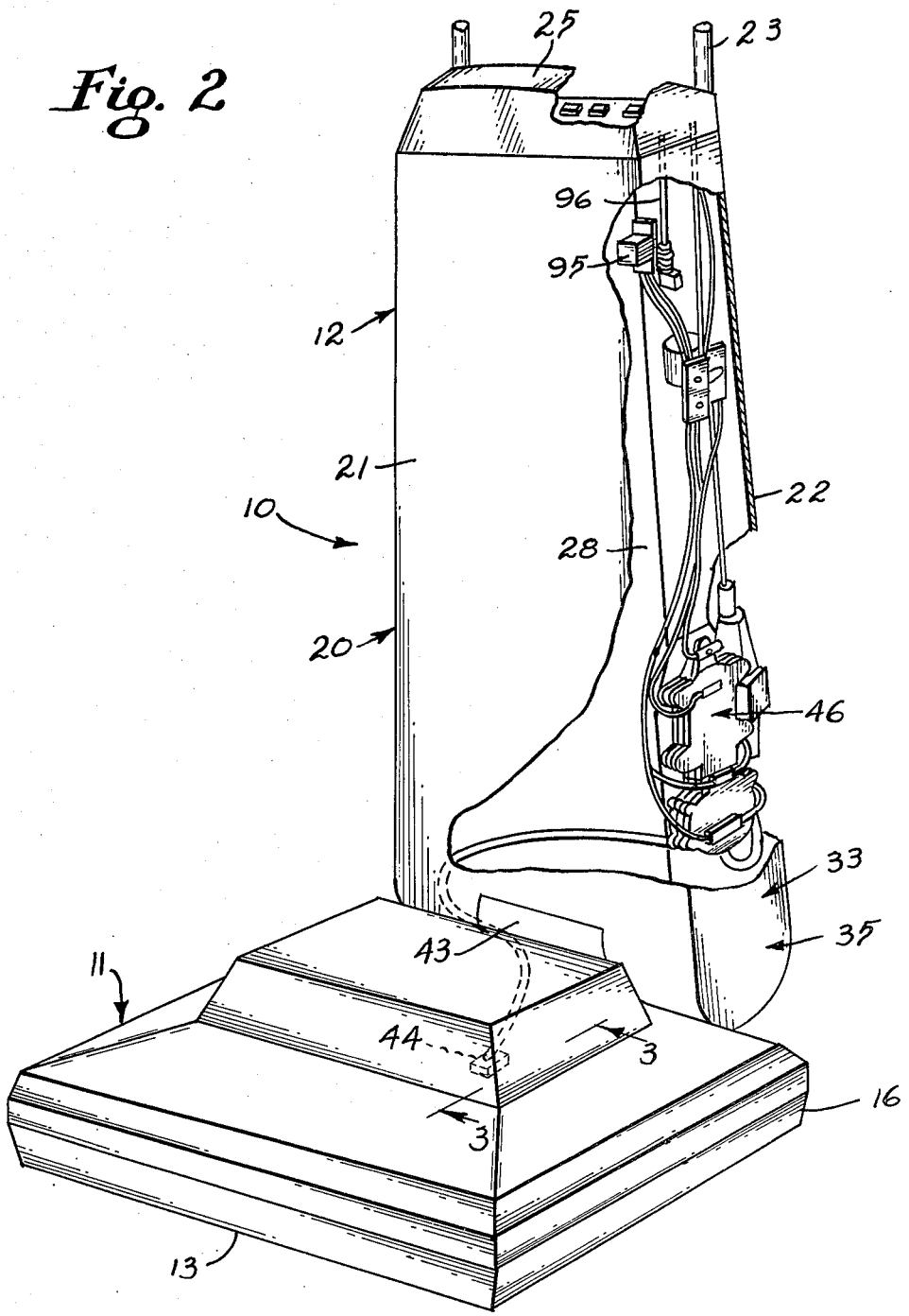
FIG. 2 is a perspective view with a portion broken away and illustrating a vacuum cleaner in accordance with the present invention.
Figure 4:
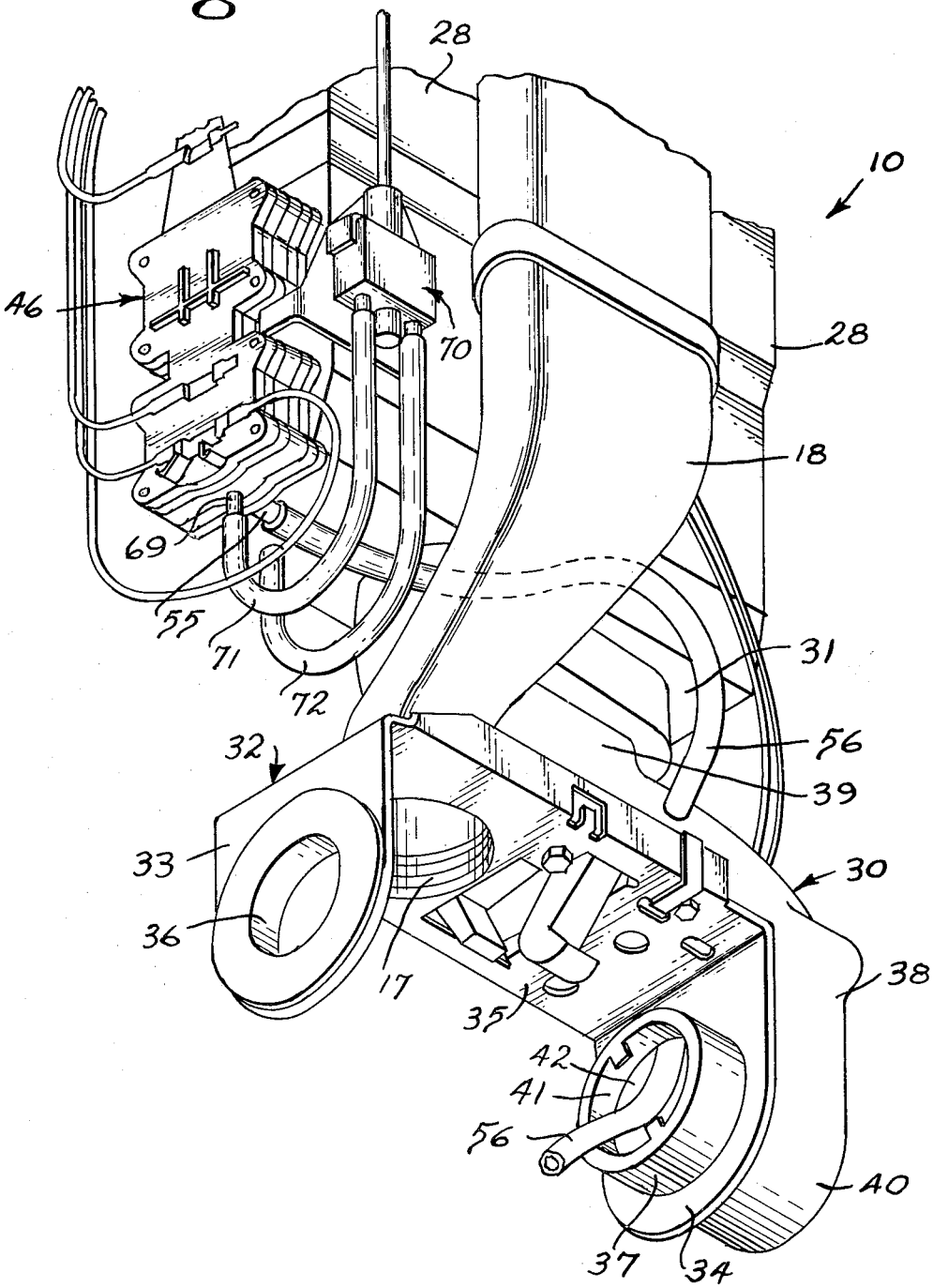
FIG. 4 is a fragmentary rear perspective view of the tank assembly portion of the vacuum cleaner.
Figure 5:
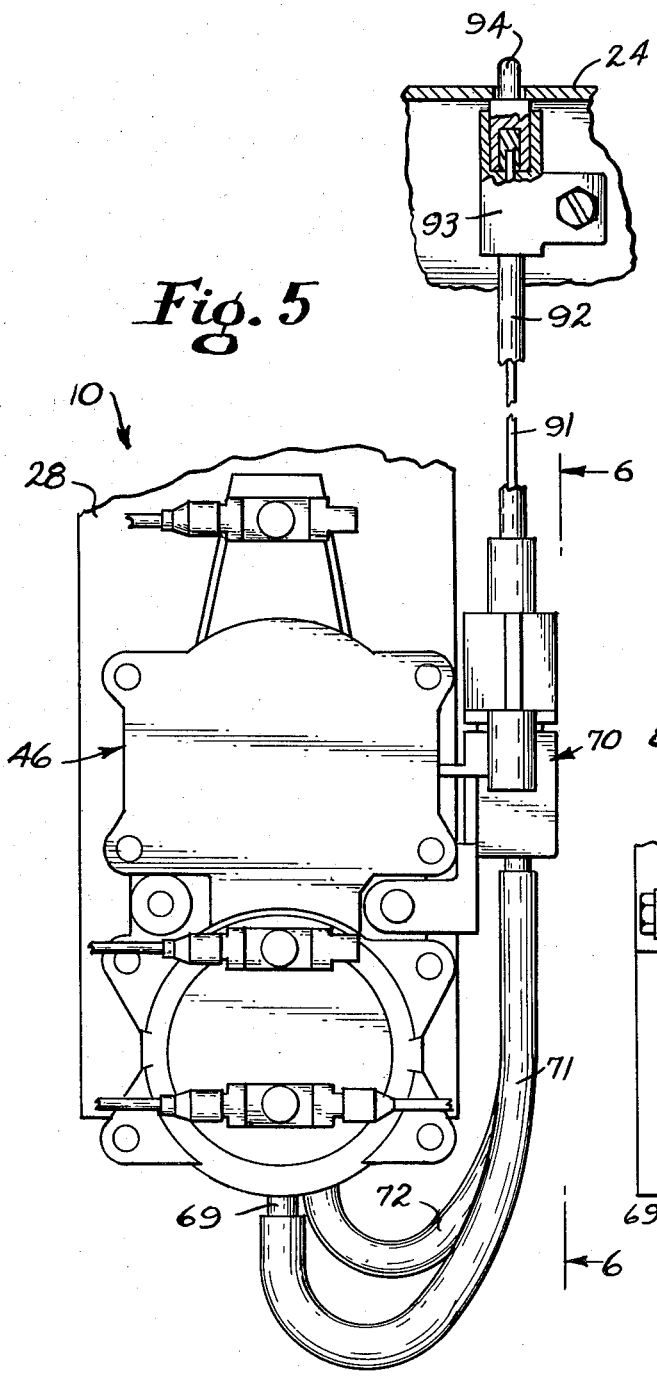
FIG. 5 is an enlarged fragmentary side elevational view of a portion of the structure of FIG. 4.

With particular reference to FIGS. 2, 4 and 7, the details of the tank assembly 12 are shown. The assembly includes a housing 20 having front and rear panels 21 and 22, respectively. A handle 23, which may be either fixed or collapsible, projects beyond the housing adjacent the rear panel 22. A filter or bag access door 25 is horizontally mounted so as to be selectively opened or closed over the upper wall 24 of the housing. When the filter door is closed, it functions to form an inverted U-shaped fluid passage which connects the upper end 26 of the dirty air channel 18 with the inlet 27 of the filter housing 28.

The filter housing 28 is generally hollow and occupies most of the space within the body or tank housing 12 and forms a container in which a conventional vacuum cleaner filter bag B is normally retained during operation. The portion within the filter housing 28 which is exterior of the filter bag B constitutes the first portion 29 of a clean air passageway.

In order to connect the head assembly 11 to the tank assembly 12 in a manner to permit relative movement therebetween, a coupling member 30 is supported by the lower portion 31 of the filter housing 28 and such coupling member includes an inverted U-shaped yoke 32 having generally parallel legs 33 and 34 connected by a web 35. The leg 33 has an opening which receives a flanged bearing member 36 and the leg 34 has an opening in alignment with a bearing sleeve or cup 37 which is welded or otherwise attached to such leg in axial alignment with the bearing 36. A hollow chamber 38 is mounted on the yoke 32 and includes an upstream portion 39 which communicates with the interior of the filter housing 28. The downstream portion 40 of the hollow chamber 38 is provided with a sleeve 41 which extends through the opening in the leg 34 and is received within the bearing sleeve 37. The bearing member 36 and the sleeve or cup 37 are cooperatively, selectively and rotatably received within an upstanding adapter 43 (FIG. 2) which is located adjacent the rear portion 16 of the power head assembly 11. At least the sleeve 37 is connected to the adapter 43 by a conventional rotary seal (not shown) to form a substantially air tight connection. In this manner the body or tank assembly 12 is operatively and physically connected to the power head assembly 11 with the hollow chamber 38 defining a second portion 42 of the clean air passageway which extends from the lower portion 32 of the filter housing 28 to the adapter 43 on power head assembly 11. The second portion of the clean air passageway connects with a third portion of the clean air passageway or duct (not shown) within the power head assembly through which clean air is moved past the vacuum fan to cool the fan motor M.

In order to protect the motor M from overheating caused as a result of the additional thermal load which is created should a blockage occur anywhere within the dirty air passageways or filter, the vacuum cleaner is provided with an automatic motor shutoff system 45. This automatic motor shutoff system is responsive to the differential pressure or other selected characteristic of the air flow between an intake or sensor 44 (FIG. 2) located in the dirty air intake passageway 15 adjacent to the vacuum intake and the clean air passing from the filter bag B through the clean air passageway into the fan unit within the power head assembly 11. By sensing the air pressures or other selected condition of the air flow at these points, a blockage anywhere in the dirty air system will be detected and power to the motor will be shut off in response thereto. It is contemplated that a plurality of intakes or sensors 44 could be located contiguous to the vacuum intake and the information from each of the intakes or sensors would be integrated to transmit an average reading of the conditions at the mouth of the dirty air system.

The automatic motor shutoff system 45 includes a pressure differential or selected air flow condition sensor 46 including a normally open diaphragm switch 47 which is electrically connected in circuit with a relay coil 48, power on-off switch 50 and indicator signal S.

Figure 3:
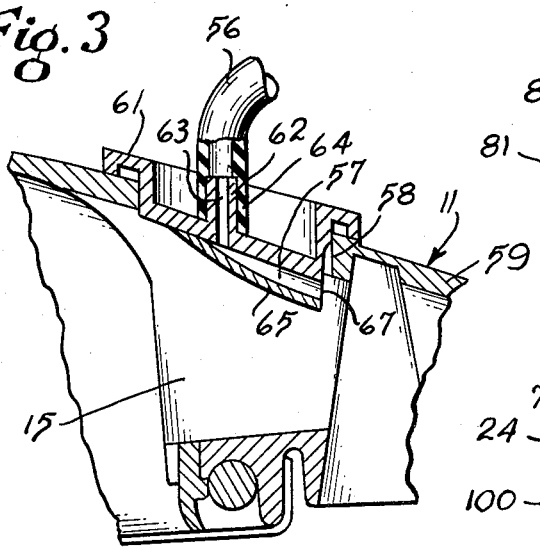
FIG. 3 is an enlarged fragmentary sectional view taken along line 3—3 of FIG. 2.

When the characteristic of the air flow being sensed is a difference in pressure, the sensor 46 includes a pressure sensitive diaphragm which is acted upon on one side by the pressure of the air along the dirty air passageway 15 in the motor head assembly 11 and on the other by the pressure of the clean air within the clean air passageway. In this regard, the sensor 46 includes a dirty air pressure tap 55 which is in open communication via a first flexible hose 56 with the intake 44. As illustrated best in FIG. 3, the intake 44 includes a pressure sensing chamber 57 mounted through an opening 58 in the upper wall 59 of the dirty air inlet passageway 15. The hose 56 extends from the dirty air pressure tap 55 of the pressure sensor 46 downwardly through the hollow chamber 38 of the coupling member 30 and through adapter 43 and into the power base assembly 11.

The pressure sensing chamber 57 includes a cover member 61 which is secured in an airtight manner within the opening 58 in the upper wall 59 of the dirty air inlet passageway 15. An outwardly extending integrally formed sleeve 62 extends from the cover member 61 and defines an opening 63 therethrough. The remote end 64 of the first flexible hose 56 is of a size to be securely connected in an airtight relationship over the sleeve 62. In order to prevent dirt or other foreign material from clogging the opening 63, a deflecting shield 65 is secured to the cover member 61 and defines an opening 67 which is situated downstream of the opening 63 through the sleeve 62.

Under normal operating circumstances, as the dirty air is drawn through the passageway 15, the pressure or other characteristic of the air flow is directly communicated to one side of the diaphragm of the pressure sensor 46 through hose 56.

Extending from the lower portion of the differential pressure sensor 46 is a second or clean air tap 69 which is connected to one side of a by-pass valve 70 by way of flexible hose 71. The other side of the valve 70 is connected by a flexible hose 72 to a nipple 73 communicating with the clean air passageway in any desired location such as the lower portion 31 of the filter housing 28. In this manner, the second side of the diaphragm within the pressure sensor 46 is in communication with the clean air passageway.

In many conventional clean air vacuum systems, a separate cleaning hose may be connected thereto so as to be in direct fluid communication with the vacuum fan while bypassing at least a portion of the dirty air passageway of the vacuum assembly so as to enable other vacuum tools, such as crevice tools, upholstery brushes and the like to be used with the basic vacuum unit.

With particular reference to FIG. 7, a cleaning hose adapter unit 75 is shown as it would be selectively connected for use with the vacuum cleaner of the present invention. The adapter unit 75 includes a generally planar adapter plate 76 having a coupling sleeve 77 extending therefrom to selectively receive one end of a flexible vacuum hose 78.

In order that the adapter unit may be selectively attached to the upper wall 24 of the body 12 of the vacuum cleaner, the access door or panel 25 is removed from its normally closed position over such upper wall of the body. A pair of openings or slots 79 are provided in the upper wall portion 24 and cooperatively receive locking members 80 which are supported adjacent to the ends 81 of the adapter plate 76 of the adapter unit 75. The slots 79 are positioned so as to align the coupling sleeve 77 with the filter inlet 27 and bag B. In this position the adapter plate 76 closes and blocks the upper end 26 of the dirty air channel 18 so that the suction from the fan is applied to the hose 78.

When the accessory hose adapter unit 75 is locked in place, suction will be through the hose 78 directly into the bag or filter and thus the dirty air passageway 15 and channel or tube 18 will no longer be in fluid communication with the vacuum fan. Under such circumstances, the pressure diaphragm switch 47 may operate to prevent operation of the vacuum motor since the differential pressure between the dirty air side of the system, as sensed at the pressure sensing chamber 57 which is now substantially at atmospheric pressure and the clean air side of the system, as sensed adjacent the lower portion 31 of the filter housing 28 could be somewhat similar to a differential pressure created by a blockage in the dirty air system because of the additional pressure loss in the hose. Thus the diaphragm switch 47 may be operated and the power to the motor M may be interrupted by the activation of the relay coil 48.

Figure 6:
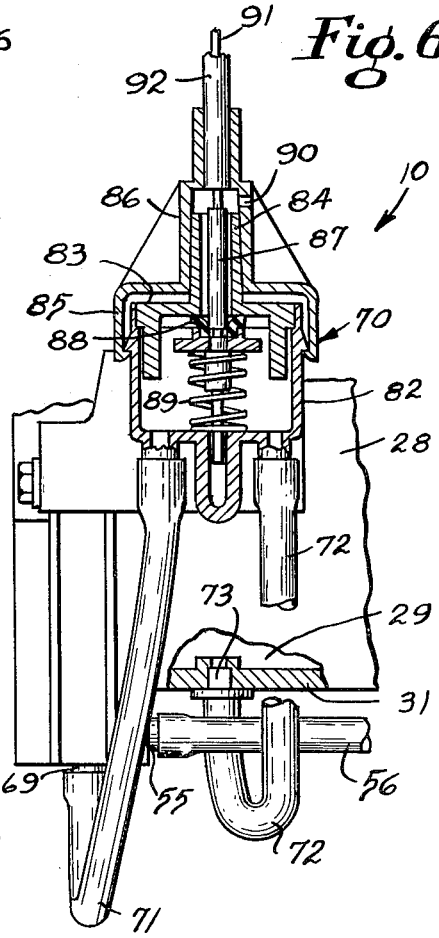
FIG. 6 is a fragmentary sectional view taken along the line 6—6 of FIG. 5.

With particular reference to FIG. 6, in order to override the automatic motor shut-off system 45 and prevent operation of the diaphragm switch 47, and thereby enable the motor M to be operated when using the hose adaptor unit 75, the by-pass valve 70 includes a hollow body 82 which normally functions as a fluid channel between the hoses 71 and 72. Such hollow body is secured to a fixed structure such as the filter housing 28 in any desired manner such as by screws or the like. The body 82 is provided with a cap 83 having an upwardly extending hollow projection 84 and such cap is held in position on the body by a resilient snap type yoke 85. The yoke 85 includes a sleeve 86 which receives the projection 84 in an airtight relationship and such yoke holds the cap 83 on the body 82 in an airtight manner. A valve stem 87 extends through the body 82 and the hollow projection 84 and such valve stem carries a resilient valve member 88 which normally is urged against the cap 83 by a spring 89 to close the hollow projection 84 and interrupt communication between the hollow body and the atmosphere. The sleeve 86 has an opening 90 located above the projection 84 for a purpose which will be described later.

An elongated pushrod 91 is mounted within a flexible tube 92 having one end secured to the sleeve 86 and the other end attached to a fitting 93 at the upper end of the filter housing 28. One end of the pushrod 91 is connected to the valve stem 87 and the other end extends through the fitting 93 and is connected to a pushbutton 94 which extends through an opening in the upper wall 24.

During normal operation with the filter access panel 25 in position over the upper wall 24 of the tank assembly 12 the rod 91 is urged upwardly by the valve stem 87 and the spring 89 so as to extend the pushbutton 94 above the upper body wall 24. When the button 94 is extended, the valve member 88 seals the hollow body 82 and provides a passage from the clean air tap 69 of the diaphragm sensor 46 to the lower portion of the filter chamber 32 by establishing an open fluid channel between hoses 71 and 72. When the bag access panel is removed and the hose adaptor unit 75 is mounted on the vacuum cleaner, the adaptor plate 76 moves the pushrod 91 downwardly against the pressure of the spring 89 to unseat the valve member 88. When the valve member is unseated, the hollow body 82 communicates with the atmosphere through the hollow projection 84 and opening 90. Since the diaphragm switch does not sense any pressure in either the dirty air passageways or the clean air passageways, no presure differential is apparent to the switch and the automatic motor shut-off system will be effectively by-passed. Thus the electrical current will be available to the motor.

The vacuum cleaner of the present invention is further provided with a single pole double throw filter bag lockout switch 95 which operatively interrupts the electricity to the motor M when a filter bag is not positioned within the filter housing 32. The filter bag lockout switch 95 includes a spring loaded switch rod 96 which extends therefrom upwardly through the upper wall 24 of the tank assembly 12. When a vacuum filter bag B is placed within the housing, the lip 100 of the bag B engages the button 101 of the switch rod 96. When the bag access panel is closed, the lip 100 of the filter bag is urged downwardly depressing the switch rod 96 and closing the filter bag lockout switch to thereby permit operation of the motor.

It will be evident from the foregoing that the bag lockout switch 95 also will interrupt energy to the motor when either the filter bag access panel 25 or hose adapter unit 75 are not in place on the upper wall 24 of the tank assembly 12.

With particular reference to FIG. 1, there is shown the electrical circuit for the motor shutoff system of the present invention. Power is supplied to the motor M by way of an on-off switch 50. If the filter bag is properly located within the housing 28 and the bag access door 25 or the hose adapter unit 75 is in place, the switch rod 96 is depressed thereby causing the bag lockout switch 95 to be closed on contact 102 so that current is supplied to the motor when the switch 50 is closed.

In the event the filter bag B is not placed in the housing 32, the switch rod is not urged downwardly upon closing the bag access panel 25 and thus the bag lockout switch 95 is in its normal position in engagement with contact 103 (as shown in dotted lines). In such case, the relay coil 48 causes the relay switch 104 to be urged from its normally closed engagement with contact 105 into engagement with contact 106. When this occurs, current is interrupted to the motor M and energizes on indicator signal S to warn the user that the filter bag is not in place.

Additionally, current to the motor M is interrupted if the sensor 46 causes the switch 47 to be activated in response to a predetermined pressure differential or other selected characteristic of the air flow between the dirty air entering the vacuum system through passageway 15 and the clean air exiting the filter chamber or housing 32. The diaphragm switch 47 normally is open thereby providing current to the motor M when the on-off switch 50 is activated. However, when the diaphragm switch is closed due to the condition being sensed by the sensor 46, the relay coil 48 is activated thereby moving the relay switch 104 into engagement with the contact 106 and interrupting electrical current to the motor and simultaneously energizing the indicator signal S. The signal S alerts the user to check for a full filter bag or for blockage anywhere in the dirty air system, including the inlet passageway 15 and the dirty air tube 18.

I claim:

1. In a vacuum cleaner having a motor, a nozzle intake, dirty air passageways extending from the nozzle intake to a filter, a housing for the filter, and a door in the housing for access to the filter, a fan operably connected to the motor to draw air through the dirty air passageways and the filter, and a clean air passageway extending between the filter and the fan, the improvement comprising:

means for sensing the differential pressure between the dirty air passageways at a first point ajacent the nozzle intake and at a second point along the clean air passageway, a first switch means responsive to a predetermined change in the differential pressure due to clogging of the dirty air passageways or a full filter, relay means normally electrically connecting said first switch means and the motor, said relay means being activated in response to said first switch means to interrupt power to the motor until said relay is reset, a second switch means operatively connected through said relay means to interrupt power to the motor in response to the absence of the filter in the filter housing, and a bypass valve means selectively connecting said sensing means to atmosphere for defeating the operation of said pressure differential sensing means to thereby permit an auxiliary cleaning tool to be operatively connected along the dirty air passageway.

2. In a vacuum cleaner having a housing with an access door for a filter, an air intake in said housing, a filter removably mounted in said housing in a position remote from said air intake, a dirty air passageway extending from said intake to said filter, a motor spaced from said filter, a fan operably connected to said motor, a clean air passageway providing communication between said filter and said fan, and means connecting said motor to a source of power so that said fan causes air to flow from said intake through said dirty air passageway and said filter and said clean air passageway when said motor is operated, the improvement comprising:

a pressure differential sensor located within said housing, one side of said sensor communicating with said air intake, the other side of said sensor communicating with said clean air passageway, said sensor including switch means responsive to a predetermined change in pressure in said sensor due to clogging of said dirty air passageway from said intake to said clean air passageway, cutoff means positioned and arranged with respect to said means connecting said motor to a source of power and said switch means such that said cutoff means is activated in response to said switch means to interrupt power to said motor as long as the predetermined pressure differential exists, whereby a blockage of air flow anywhere between said air intake and said clean air passageway causes said motor to be de-energized.

3. The vacuum cleaner of claim 2 including indicator means connected in circuit with said cutoff means and energized when said cutoff means is activated to signal the user that a blockage has occurred.

4. The vacuum cleaner of claim 2 in which said cutoff means includes a relay having a normally open contact and a normally closed contact, said normally closed contact functioning to connect said source of power to the motor, and said normally open contact functioning upon energization of said relay to lock said relay in the energized state interrupting the power to the motor.

5. The vacuum cleaner of claim 2 including a second switch means in said means connecting said motor to a source of power to interrupt power to the motor in response to the absence of the filter in said housing.

6. The vacuum cleaner of claim 2 including bypass valve means for selectively interrupting the fluid communication between said sensor and said clean air passageway to thereby defeat the operation of said pressure differential sensor.

7. The vacuum cleaner of claim 6 in which said bypass valve means includes a valve housing having an inlet and outlet connected in normally open fluid communication between said sensor and said clean air passageway, valve means movable within said housing between an open and closed position, an elongated valve rod connected to said valve means and operatively extending to adjacent the filter access door, whereby when the door is moved and an auxiliary cleaning tool is operably connected to said dirty air passageway, said valve rod is acted upon to move said valve means to said open position interrupting the fluid communication between said pressure sensing means and said clean air passageway.

* * * * *